US007461467B2

(12) United States Patent
Park et al.

(10) Patent No.: US 7,461,467 B2
(45) Date of Patent: Dec. 9, 2008

(54) SAFETY CRAMPON WITH GENERALITY PUT ON

(75) Inventors: Wan Do Park, Kyunggi-Do (KR); Chang Moo Jung, Kyunggi-Do (KR)

(73) Assignees: Wookyung Tech Co., Ltd., Kyunggi-Do (KR); KPM Global Co., Kyunggi-Do (KR)

( * ) Notice: Subject to any disclaimer, the term of this patent is extended or adjusted under 35 U.S.C. 154(b) by 313 days.

(21) Appl. No.: 11/241,971

(22) Filed: Oct. 4, 2005

(65) Prior Publication Data

US 2006/0080861 A1 Apr. 20, 2006

(30) Foreign Application Priority Data

Oct. 14, 2004 (KR) ..... 2004-82017
Jul. 1, 2005 (KR) ..... 10-2005-0059111

(51) Int. Cl.
*A43B 3/18* (2006.01)

(52) U.S. Cl. ..... 36/7.6; 36/7.7

(58) Field of Classification Search ..... 36/7.6, 36/7.7, 7.4, 62
See application file for complete search history.

(56) References Cited

U.S. PATENT DOCUMENTS 2,342,777 A * 2/1944 Wisckol ..... 36/59 R
3,095,657 A * 7/1963 Fradette ..... 36/7.6
5,813,143 A * 9/1998 Bell et al. ..... 36/59 R
5,966,840 A * 10/1999 Bell et al. ..... 36/7.6
6,154,982 A * 12/2000 Bell et al. ..... 36/7.6
2003/0154626 A1* 8/2003 Larson et al. ..... 36/7.6
2004/0045190 A1* 3/2004 Washburn et al. ..... 36/7.6
2005/0198860 A1* 9/2005 Larson et al. ..... 36/7.6

FOREIGN PATENT DOCUMENTS

KR 3020680 11/1995

* cited by examiner

*Primary Examiner*—Ted Kavanaugh
(74) *Attorney, Agent, or Firm*—Dykema Gossett PLLC

(57) ABSTRACT

Disclosed is a safety crampon with generality put on, which encircles front/rear/left/right sides of shoes around a spike pad to elastically press and grip them so that the crampon is not come off from the shoes, thereby ensuring safety. Also, the safety crampon has excellent wearing feeling and walking owing to characteristics of an elastic material, can be put on all kinds of shoes including mountain-climbing boots, high-heeled shoes, and rubber shoes, allows a user to safely climb a mountain and safely walk on a skiddy icy road of the ground, and has a conveniently portable advantage. The anti-skid safety crampon includes a spike pad made of an elastic material such as a foaming resin or rubber and provided with a plurality of spikes, a hook formed in the spike pad in a single body with the spike pad to be fixably hooked over shoes, a limb band oriented from four edges of the spike pad toward the contour, and a ring band inscribed in a front end of the limb band, wherein the spike pad, the hook, the limb band and the ring band are formed of an elastic material in a single body with one another.

7 Claims, 5 Drawing Sheets

PRIOR ART

SAFETY CRAMPON WITH GENERALITY PUT ON

The present application claims the benefit of priority to Korean Application No. 2004-82017 filed Oct. 14, 2004 and Korean Application No. 2005-59111, filed Jul. 1, 2005, hereby incorporated by reference in their entirety.

BACKGROUND OF THE INVENTION

1. Field of the Invention

The present invention relates to an antiskid crampon, and more particularly, to a safety crampon with generality put on, which encircles front/rear/left/right sides of shoes around a spike pad to elastically press and grip them so that the crampon is not come off from the shoes, thereby ensuring safety. Also, the present invention relates to a safety crampon with generality put on, which has excellent wearing feeling and walking owing to characteristics of an elastic material, can be put on all kinds of shoes including mountain-climbing boots, high-heeled shoes, and rubber shoes, allows a user to safely climb a mountain and safely walk on a skiddy icy road of the ground, and has a conveniently portable advantage.

2. Background of the Prior Art

Generally, a crampon which a user puts on for safe climbing in the winter season is divided into a fixed type fixed to shoes in a single body and a detachable type detachably fixed to shoes using a securing band and so on.

A conventional detachable crampon is provided in such a way that a spike is protruded on a rigid metal plate. Therefore, the conventional detachable crampon has no flexibility. For this reason, it is inconvenient for a user to carry and handle the crampon. Also, such a crampon may hurt the user. Moreover, since the conventional detachable crampon has a size relatively greater and higher than that of shoes, problems occur in that it is difficult for the user to maintain the balance and inconvenience is caused during walking.

Furthermore, a problem occurs in that it is difficult to use the crampon on an icy road of the ground except for climbing due to such inconvenience in wearing feeling and walking.

Meanwhile, a related art crampon 100 is disclosed in the Japanese Utility Model No. 3020680 (registered on Nov. 15, 1995), in which a pushpin 110 is protruded on a spike pad 120 of a soft material such as rubber, and hooks 130 and 140 are formed in a single body with the spike pad 120 and fixably hooked over the toe and the heel of shoes, as shown in FIG. 7A and FIG. 7B.

In the related art crampon 100, since the spike pad 120 and the hooks 130 and 140 have elasticity, it is convenient to put on and carry the crampon.

However, the aforementioned crampon 100 has several problems. Since the hooks are unstably formed only at the front and rear of the spike pad 120, the crampon may be come off from the shoes during climbing, thereby deteriorating safety. Also, since the pushpin 110 serving as a spike is formed of a single pillar, it is difficult for the user to maintain the balance. Moreover, a problem occurs in that the pushpin may be broken or bent.

SUMMARY OF THE INVENTION

The present invention is directed to a safety crampon with generality put on, which substantially obviates one or more problems due to limitations and disadvantages of the related art.

An object of the present invention is to provide a safety crampon with generality put on, which encircles front/rear/left/right sides of shoes around a spike pad to elastically press and grip them so that the crampon is not come off from the shoes, thereby ensuring safety.

Another object of the present invention is to provide a safety crampon with generality put on, which has excellent wearing feeling and walking owing to characteristics of an elastic material, can be put on all kinds of shoes including mountain-climbing boots, high-heeled shoes, and rubber shoes, allows a user to safely climb a mountain and safely walk on a skiddy icy road of the ground, and has a conveniently portable advantage.

To achieve these objects and other advantages and in accordance with the purpose of the invention, as embodied and broadly described herein, an antiskid safety crampon with generality put on according to the present invention includes a spike pad made of an elastic material such as a foaming resin or rubber and provided with a plurality of spikes, a hook formed in the spike pad in a single body with the spike pad to be fixably hooked over shoes, a limb band oriented from four edges of the spike pad toward the contour, and a ring band inscribed in a front end of the limb band, wherein the spike pad, the hook, the limb band and the ring band are formed of an elastic material in a single body with one another.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, illustrate embodiments of the invention and together with the description serve to explain the principle of the invention.

DETAILED DESCRIPTION OF THE PREFERRED EMBODIMENTS

Reference will now be made in detail to the preferred embodiments of the present invention, examples of which are illustrated in the accompanying drawings.

Hereinafter, a safety crampon with generality put on according to the present invention will be described in detail with reference to the accompanying drawings.

Figure 1:
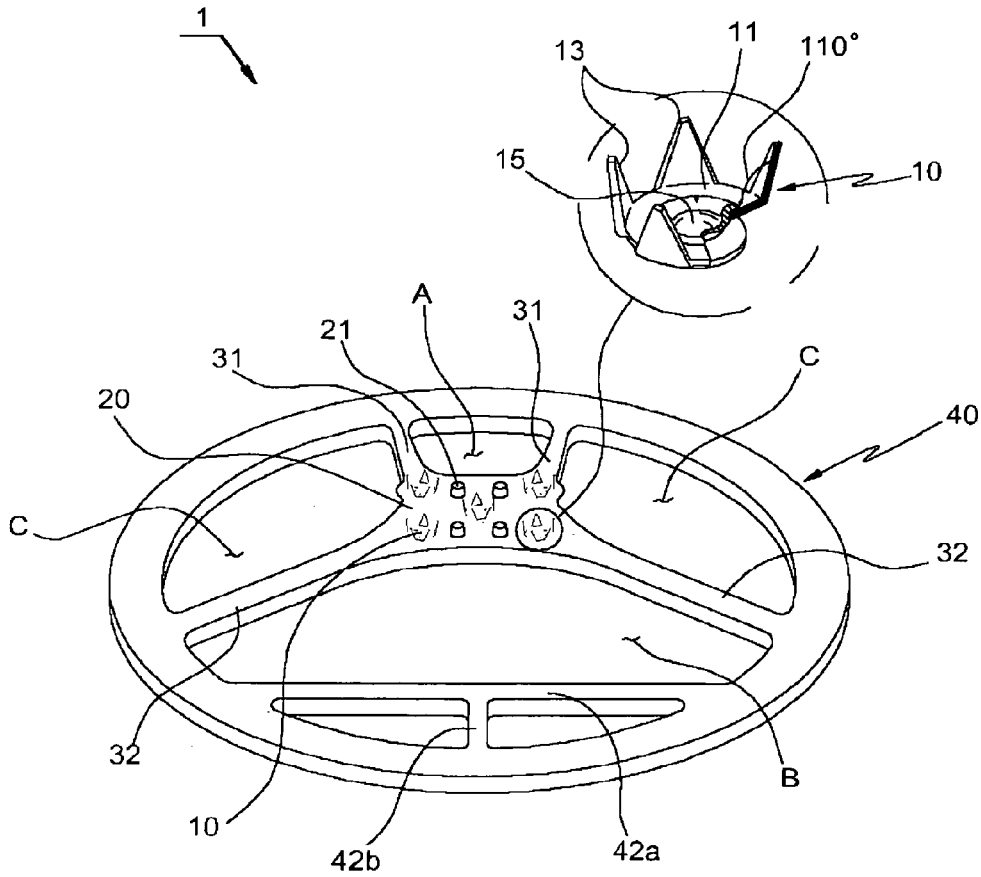
FIG. 1 is a perspective view illustrating a safety crampon with generality put on according to the first embodiment of the present invention.
Figure 2:
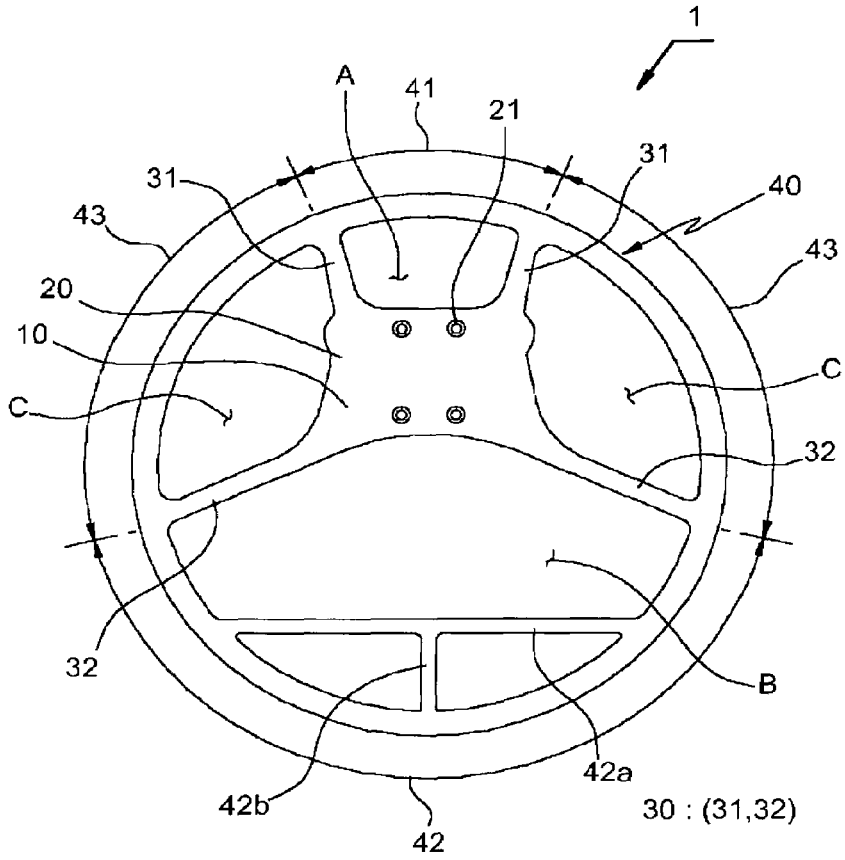
FIG. 2 is a plane view of FIG. 1.
Figure 3:
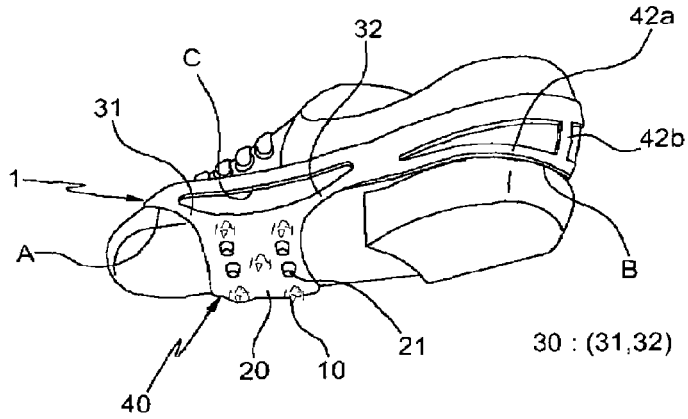
FIG. 3 illustrates the state that the safety crampon of FIG. 1 is put on shoes.

FIG. 1 is a perspective view illustrating a safety crampon with generality put on according to the first embodiment of the present invention, FIG. 2 is a plane view of FIG. 1, and FIG. 3 illustrates the state that the safety crampon of FIG. 1 is put on shoes.

As shown in FIG. 1 to FIG. 3, an antiskid safety crampon 1 with generality put on according to the present invention includes a spike pad 20 of an elastic material such as a foaming resin or rubber provided with a plurality of spikes 10, a hook formed in the spike pad 20 in a single body with the spike pad 20 to be fixably hooked over shoes, a limb band 30 oriented from four edges of the spike pad 20 toward the contour, and a ring band 40 inscribed in a front end of the limb band 30, wherein the spike pad 20, the hook, the limb band 30 and the ring band 40 are formed of an elastic material in a single body with one another.

Preferably, the ring band 40 has a rounded ring shape. Also, the spikes 10 are provided with a plurality of claws 13 bent and protruded along the circumference of a disk unit 11. The disk unit 11 is preferably fixed to the spike pad 20 by a rivet 15. The rivet has a flat head. The claws of the spikes are preferably bent at an angle of 110° from the disk unit 11.

As described above, the claws 13 are circumferentially arranged to effectively avoid sliding and stably ensure a landing. Therefore, it is convenient to use the crampon, and safety against snap or bending can be obtained. This could lead to stable walking and long life of the crampon.

Furthermore, since the claws are slanted at an angle of 110°, it is possible to prevent ice pieces from entering the spikes 10, thereby failing to make a lump. Even if some lump of the ice pieces is made, such a lump is easily removed from the spikes 10 to allow the spikes 10 to serve to perform their braking function. The front end of the claws is smoothly finished without any sharpness to allow a user to stably walk.

Furthermore, the spike pad 20 is provided with a plurality of elastic protrusions 21 formed in a single body with the spike pad 20.

The elastic protrusions 21 serve to reinforce stability of the spikes and push snow or ice pieces adhered to the claws or the spike pads out using elasticity.

The limb band 30 includes first bands 31 oriented toward the toe of the shoes and symmetrically formed, and second bands 32 oriented toward the heel of the shoes and symmetrically formed. The limb band 30 further includes a trapezoidal toe hook A formed by the first bands 31 and a first arc 41 of the ring band 40 that connects the first bands 31 with each other, a fan shaped heel hook B formed by the second bands 32 and a second arc 42 of the ring band 40 that connects the second bands 32 with each other, and a both-side pressing portion C formed by a third arc 43 that connects the first arc 41 with the second arc 42.

Preferably, the second arc 42 is longer than the first arc 41 so that the spike pad 20 is fixed to the front of the sole of the shoes.

Furthermore, the second arc 42 is provided with a third band 42*a* formed across the inside of the crampon and a fourth band 42*b* that connects a middle portion of the third band 42*a* with a middle portion of the second arc 42. The third band 42*a* and the fourth band 42*b* are formed in a single body with each other.

Figure 4:
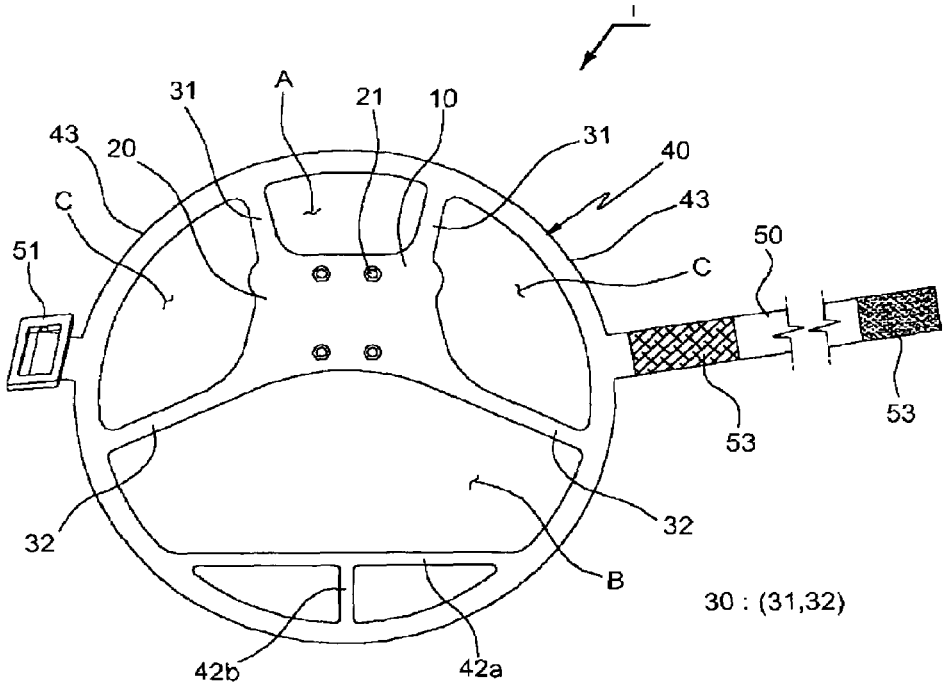
FIG. 4 illustrates a construction of a safety crampon with generality put on according to the second embodiment of the present invention.
Figure 5:
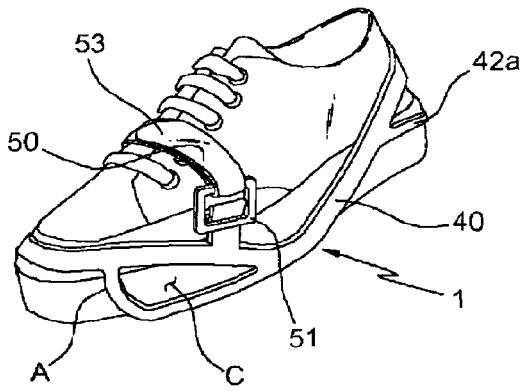
FIG. 5 illustrates the state that the safety crampon of FIG. 4 is put on shoes.

FIG. 4 illustrates a construction of a safety crampon with generality put on according to the second embodiment of the present invention, and FIG. 5 illustrates the state that the safety crampon of FIG. 4 is put on the shoes.

As shown in FIG. 4 and FIG. 5, the crampon according to the second embodiment of the present invention further includes a fifth band 50 formed in the ring band 40 to secure both sides of the shoes.

Preferably, the fifth band 50 serves as an elastic band, and is provided with a fastener 53 formed at any one side of left and right sides of the third arc 43 that connects the first band 31 with the second band 32 and a buckle 51 formed at the other side of left and right sides of the third arc 43.

Figure 6:
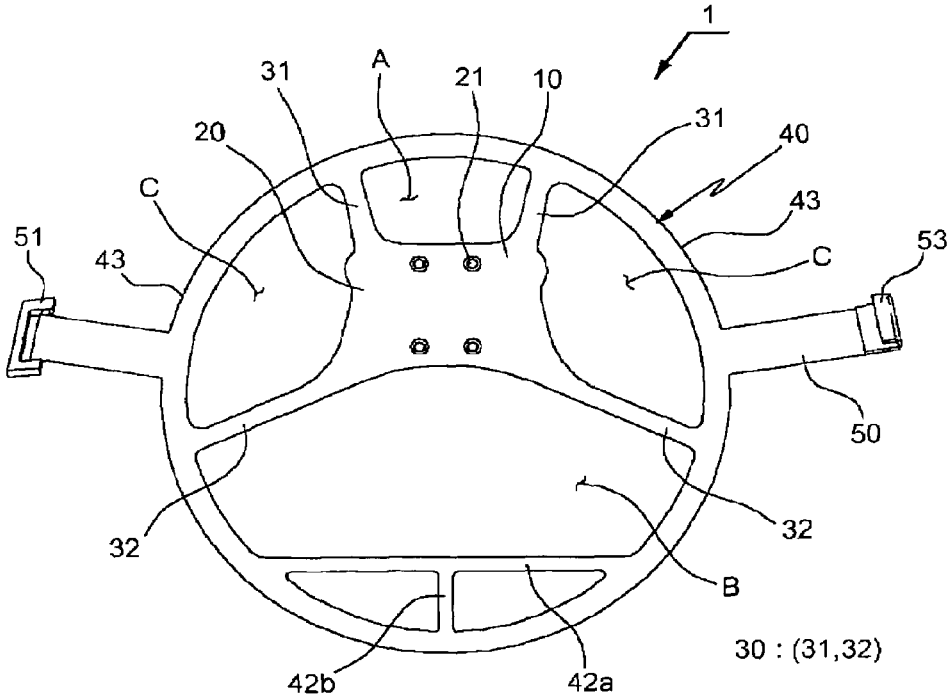
FIG. 6 illustrates a construction of a safety crampon with generality put on according to the third embodiment of the present invention.
Figure 7A:
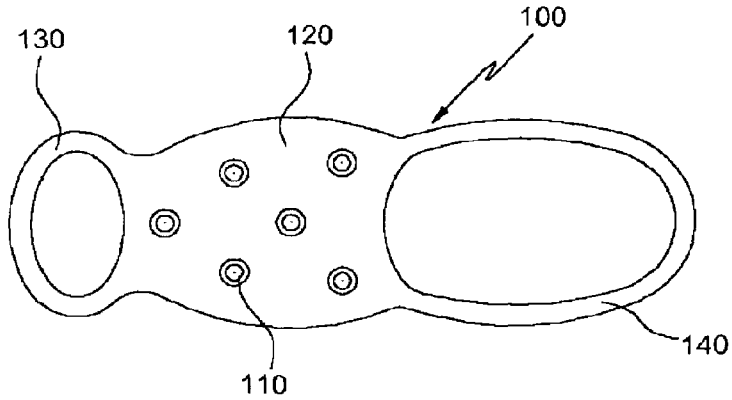
FIG. 7A illustrates a construction of a related art crampon.
Figure 7B:
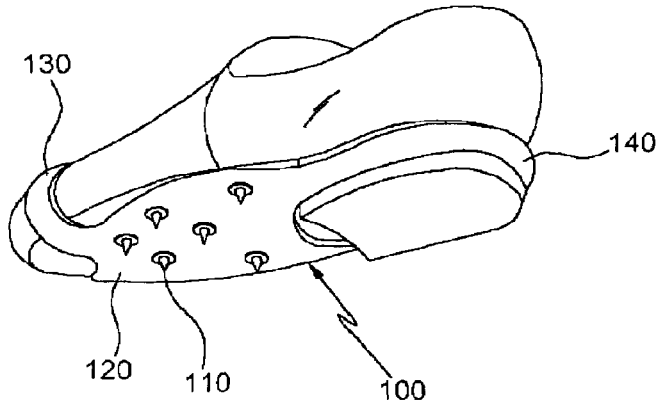
PRIOR ART FIG. 7b
FIG. 7B illustrates the state that the crampon of FIG. 7A is put on shoes.

A Velcro fiber fastener called "Velcro" may be used as the fastener 53 so that the elastic band is hooked over the buckle and then adhered to the shoes. Alternatively, a detachable hook provided on the front end of the elastic band may be used as the fastener as shown in FIG. 6.

The operation of the aforementioned safety crampon according to the present invention and its wearing state will be described.

The spike pad 20 provided with the plurality of spikes 10, the limb band 30 and the ring band 40 are formed of an elastic material in a single body with one another. When the spike pad 20, the limb band 30 and the ring band 40 are put on the shoes, the first band 31 and the first arc 41 act on the toe hook A, the second band 32 and the second arc 42 act on the heel hook B, and the third arc 43 acts on the both-side pressing portion C.

Therefore, the safety crampon encircles front/rear/left/right sides of the shoes around the spike pad 20 positioned on the sole of the shoes to elastically press and grip them. Thus, the safety crampon is not come off from the shoes even under the bad conditions, thereby ensuring safety.

Furthermore, the first arc 41 constituting the toe hook A is shorter than the second arc 42 constituting the heel hook B, and the first band 31 is arranged at an angle different from that of the second band 32 to form a trapezoidal shape and a fan shape along with the spike pad 20. In this case, the spikes are positioned toward the half sole of the shoes to maintain the balance and improve close adhesion to the shoes to prevent motion of the spikes.

Furthermore, the third band 42*a* and the fourth band 42*b* are formed in the second arc 42 corresponding to the heel hook B so that they encircle a convex portion of the heel, thereby obtaining firm and elastic fixation to avoid distortion of the bands and motion in all directions.

If the fifth band 50 is additionally provided (see FIG. 4 to FIG. 6), firmer fixation is made to obtain stability so that the crampon cannot be detached from the shoes.

As described above, the safety crampon according to the present invention has excellent wearing feeling and walking owing to characteristics of the elastic material. Therefore, the crampon can be put on all kinds of shoes including mountain-climbing boots, high-heeled shoes, and rubber shoes, and allows the user to safely climb a mountain and safely walk on a skiddy icy road of the ground. In this way, the crampon is widely used and has a conveniently portable advantage.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As described above, the safety crampon with generality put on according to the present invention has the following advantages.

The safety crampon elastically encircles front/rear/left/right sides of shoes around the spike pad to elastically press and grip them so that the crampon is not come off from the shoes, thereby ensuring safety. Also, the safety crampon has excellent wearing feeling and walking owing to characteristics of the elastic material, can be put on all kinds of shoes including mountain-climbing boots, high-heeled shoes, and rubber shoes, and allows the user to safely climb a mountain and safely walk on a skiddy icy road of the ground. Moreover, the safety crampon has a conveniently portable advantage.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. An antiskid safety crampon (1) with generality put on comprising:

a spike pad (20) of an elastic material such as a foaming resin or rubber provided with a plurality of spikes (10); and a hook formed in the spike pad (20) in a single body with the spike pad (20) to be fixably hooked over shoes, wherein the hook comprising a limb band (30) oriented from four edges of the spike pad (20) toward the contour and a ring band (40) inscribed in a front end of the limb band (30), wherein the spike pad (20), the hook, the limb band (30), and the ring band (40) are formed of an elastic material in a single body with one another, wherein the limb band (30) includes:

first bands (31) oriented toward the toe of the shoes and symmetrically formed;

second bands (32) oriented toward the heel of the shoes and symmetrically formed;

a trapezoidal toe hook (A) formed by the first band (31) and a first arc (41) of the ring band (40) that connects the first bands (31) with each other;

a fan shaped heel hook (B) formed by the second band (32) and a second arc (42) of the ring band (40) that connects the second bands (32) with each other; and a both-side pressing portion (C) formed by a third arc (43) that connects the first arc (41) with the second arc (42), wherein the second arc (42) is provided with a third band (42*a*) formed across the inside of the crampon and a fourth band (42*b*) that connects a middle portion of the third band (42*a*) with a middle portion of the second arc (42), the third band (42*a*) and the fourth band (42*b*) being formed in a single body with each other.

2. The safety crampon according to claim 1, wherein the spikes (100) are provided with a plurality of claws (13) bent and protruded along the circumference of a disk unit (11), and the disk unit (11) is fixed to the spike pad (20) by a rivet (15).

3. The safety crampon according to claim 1, wherein the spike pad (20) is provided with a plurality of elastic protrusions (21) formed in a single body with the spike pad (20).

4. The safety crampon according to claim 1, wherein the second arc (42) is longer than the first arc (41) so that the spike pad (20) is fixed to the front of the sole of the shoes.

5. The safety crampon according to claim 1, further comprising a fifth band (50) formed in the ring band (40) to secure both sides of the shoes.

6. The safety crampon according to claim 5, wherein the fifth band (50) serves as an elastic band and is provided with a clamp (53) formed at any one side of left and right sides of the third arc (43) that connects the first band (31) with the second band (32) and a buckle (51) formed at the other side of left and right sides of the third arc (43).

7. The safety crampon according to claim 1 or 2, wherein the claws (13) of the spikes are bent at an angle of 110° from the disk unit (11).

* * * * *